US009889960B2

(12) United States Patent
Duncan

(10) Patent No.: US 9,889,960 B2
(45) Date of Patent: Feb. 13, 2018

(54) SYSTEM AND METHOD FOR APPLYING TUBULAR SHRINK SLEEVE MATERIAL TO CONTAINERS

(71) Applicant: Adam W. Duncan, Apex, NC (US)

(72) Inventor: Adam W. Duncan, Apex, NC (US)

(73) Assignee: AXON LLC, Raleigh, NC (US)

( * ) Notice: Subject to any disclaimer, the term of this patent is extended or adjusted under 35 U.S.C. 154(b) by 478 days.

(21) Appl. No.: 14/594,774

(22) Filed: Jan. 12, 2015

(65) Prior Publication Data

US 2015/0210416 A1 Jul. 30, 2015

Related U.S. Application Data

(60) Provisional application No. 61/931,860, filed on Jan. 27, 2014.

(51) Int. Cl.

| | |
|---|---|
| ***B65B 41/10*** | (2006.01) |
| ***B65C 3/00*** | (2006.01) |
| ***B65C 3/06*** | (2006.01) |

(52) U.S. Cl.

CPC ..... *B65C 3/00* (2013.01); *B65C 3/065* (2013.01)

(58) Field of Classification Search

CPC ..... B65B 9/13; B65B 9/2014; B65C 3/065; B65C 3/06

USPC ..... 53/363, 585, 563

See application file for complete search history.

(56) References Cited

U.S. PATENT DOCUMENTS

| | | | | |
|---|---|---|---|---|
| 3,133,390 | A | 5/1964 | Leasure et al. | |
| 4,514,966 | A | 5/1985 | Konstantin | |
| 4,910,941 | A | 3/1990 | Nagano et al. | |
| 5,060,367 | A | 10/1991 | Vandevoorde | |
| 5,737,900 | A | 4/1998 | Konstantin et al. | |
| 6,070,399 | A | 6/2000 | Huang et al. | |
| 6,170,227 | B1 | 1/2001 | Kovacs et al. | |
| 6,684,599 | B1 | 2/2004 | Fresnel | |
| 7,024,841 | B2 * | 4/2006 | Kramer | B65C 3/065 53/291 |
| 7,343,842 | B2 * | 3/2008 | Chen | B26D 1/285 156/556 |
| 7,398,811 | B1 * | 7/2008 | Duncan | B29C 63/18 156/215 |
| 7,661,250 | B2 | 2/2010 | Vandevoorde et al. | |
| 8,146,334 | B2 | 4/2012 | Fresnel | |
| 8,621,745 | B2 * | 1/2014 | Deonarine | B65B 21/247 29/521 |

(Continued)

FOREIGN PATENT DOCUMENTS

| | | |
|---|---|---|
| EP | 2104604 | 3/2011 |
| JP | B-98973 | 12/1994 |

*Primary Examiner* — Hemant M Desai
*Assistant Examiner* — Valentin Neacsu
(74) *Attorney, Agent, or Firm* — Thompson Hine LLP

(57) ABSTRACT

A machine for applying tubular film to products includes a mandrel assembly about which tubular film is passed and a film cutter for cutting the tubular film into sleeves sized for application to containers. The mandrel assembly includes a sleeve section located below the film cutter and about which a sleeve length portion of the tubular film extends prior to each film cutting operation of the film cutter to produce a cut sleeve. A sleeve ejection arrangement includes a rotatable ejector wheel disposed along the sleeve section of the mandrel assembly.

20 Claims, 7 Drawing Sheets

(56) References Cited

U.S. PATENT DOCUMENTS

| | | | | |
|---|---|---|---|---|
| 2010/0037556 | A1* | 2/2010 | Fresnel | B65B 9/14 53/218 |
| 2010/0093507 | A1* | 4/2010 | Hoeben | B29C 63/423 493/235 |
| 2013/0118121 | A1* | 5/2013 | Heeman | B65C 3/065 53/399 |
| 2013/0118136 | A1 | 5/2013 | Arima et al. | |

* cited by examiner

SYSTEM AND METHOD FOR APPLYING TUBULAR SHRINK SLEEVE MATERIAL TO CONTAINERS

CROSS-REFERENCES

This application claims the benefit of U.S. provisional application Ser. No. 61/931,860, filed Jan. 27, 2014.

TECHNICAL FIELD

The present application relates generally to machines that apply tubular shrink sleeve material to containers and, more particularly, to a system and method for ejecting tubular shrink sleeve material from a mandrel and onto containers.

BACKGROUND

Tubular shrink sleeve application devices commonly utilize a mandrel over which a tubular shrink film is moved for cutting, and then the cut sleeve-type label is ejected from the mandrel onto a container located below the mandrel.

Typically sleeve films used in such machines have a thickness of, for example, between 40 and 60 microns. However, industry is trending more and more toward lighter weight sleeve films, such as those having a thickness of about 20 microns. Such thinner sleeve films have a greater tendency to collapse upon themselves during ejection, interfering with proper placement of the sleeves over containers.

Referring to the Prior Art system shown in FIG. 1, a typical sleever uses two ejector wheels 10. The wheels 10 are located on opposing sides of the tooling mandrel 12. Tubular film 14 is moved over the tooling mandrel 12. When a container is detected beneath the mandrel, a sleeve is cut (e.g., by a cutter 16) when the bottom edge 18 of the film is above the ejector wheels 10 per the position shown in FIG. 1. The film feed 20 pushes the cut sleeve down the tooling and into the ejector wheels 10. The ejector wheels 10 then eject the sleeve from the mandrel and onto a container 22 passing by on a conveyor. Typically, the ejector wheels work in combination with bearings 24 that protrude from the surface of the mandrel 12.

It would be desirable and advantageous to provide a system and method that facilitates suitable ejection of lighter weight films, as well as more standard weight films.

SUMMARY

In one aspect, a machine for applying tubular film to products includes a mandrel assembly about which tubular film is passed as the tubular film is fed downward over the mandrel assembly. A film cutter is positioned along the mandrel assembly for cutting the tubular film into sleeves sized for application to containers passing below the mandrel assembly. The mandrel assembly includes a sleeve section located below the film cutter and about which a sleeve length portion of the tubular film extends prior to each cutting operation of the film cutter to produce a cut sleeve. A sleeve ejection arrangement includes a rotatable ejector wheel disposed along the sleeve section of the mandrel assembly so as to be positioned along each sleeve length portion of the tubular film prior to each film cutting operation. The rotatable ejector wheel is rotated continuously during repeated feeding and cutting of the tubular film to produce multiple cut sleeves that are sequentially ejected from the mandrel assembly.

In another aspect, a machine for applying tubular film to products includes a mandrel assembly about which tubular film is passed. A film cutter is positioned along the mandrel assembly for cutting the tubular film into sleeves sized for application to containers passing below the mandrel assembly. The mandrel assembly includes a sleeve section located below the film cutter and about which a sleeve length portion of the tubular film extends prior to each film cutting operation of the film cutter to produce a cut sleeve. A sleeve ejection arrangement includes a rotatable ejector wheel disposed along the sleeve section of the mandrel assembly such that the rotatable ejector wheel is positioned along each sleeve length portion of the tubular film prior to the film cutting operation. The sleeve section of the mandrel assembly includes a spring surface aligned with and outwardly biased toward the rotatable ejector wheel.

In a further aspect, a machine for applying tubular film to products includes a mandrel assembly about which tubular film is passed. A film cutter is positioned along the mandrel assembly for cutting the tubular film into sleeves sized for application to containers passing below the mandrel assembly. The mandrel assembly includes a sleeve section located below the film cutter and about which a sleeve length portion of the tubular film extends prior to each film cutting operation of the film cutter to produce a cut sleeve. A sleeve ejection arrangement includes a rotatable ejector wheel disposed along the sleeve section of the mandrel assembly such that the rotatable ejector wheel is positioned above a bottom edge of the tubular film prior to film cutting.

In yet another aspect, a method of applying a shrink sleeve label to a container involves the steps of: (a) advancing a leading end of a supply of tubular film over a mandrel assembly, downward past a film cutter and between a sleeve ejector wheel and an outwardly biased spring surface of the mandrel assembly while the sleeve ejector wheel is rotating; and (b) stopping the advance of tubular film when a sleeve length portion of the tubular film is below the film cutter and then cutting the tubular film with the film cutter to produce a separated sleeve, wherein a contact surface of the rotatable ejector wheel slides over an exterior surface side of the sleeve length portion of the tubular film prior to the film cutting operation to pull the tubular film taught prior to the film cutting operation so the separated sleeve is ejected from the mandrel assembly as soon as the film cutting operation is completed.

In yet another aspect, a method of applying a shrink sleeve label to a container involves the steps of: advancing a leading end of a supply of tubular shrink film over a mandrel assembly, downward past a film cutter and beyond a sleeve ejector wheel that is spaced from an outer surface of the mandrel assembly; cutting the tubular shrink film with the film cutter to produce a separated sleeve; moving the sleeve ejector wheel toward the mandrel assembly and into contact with the separated sleeve and rotating the sleeve ejector wheel to eject the separated sleeve downward off of the mandrel assembly; and retracting the sleeve ejector wheel away from the mandrel assembly so as to space the sleeve ejector wheel from the outer surface of the mandrel assembly in order to permit the leading end of the tubular shrink film to again be advanced.

The details of one or more embodiments are set forth in the accompanying drawings and the description below. Other features, objects, and advantages will be apparent from the description and drawings, and from the claims.

DETAILED DESCRIPTION

Figure 1:
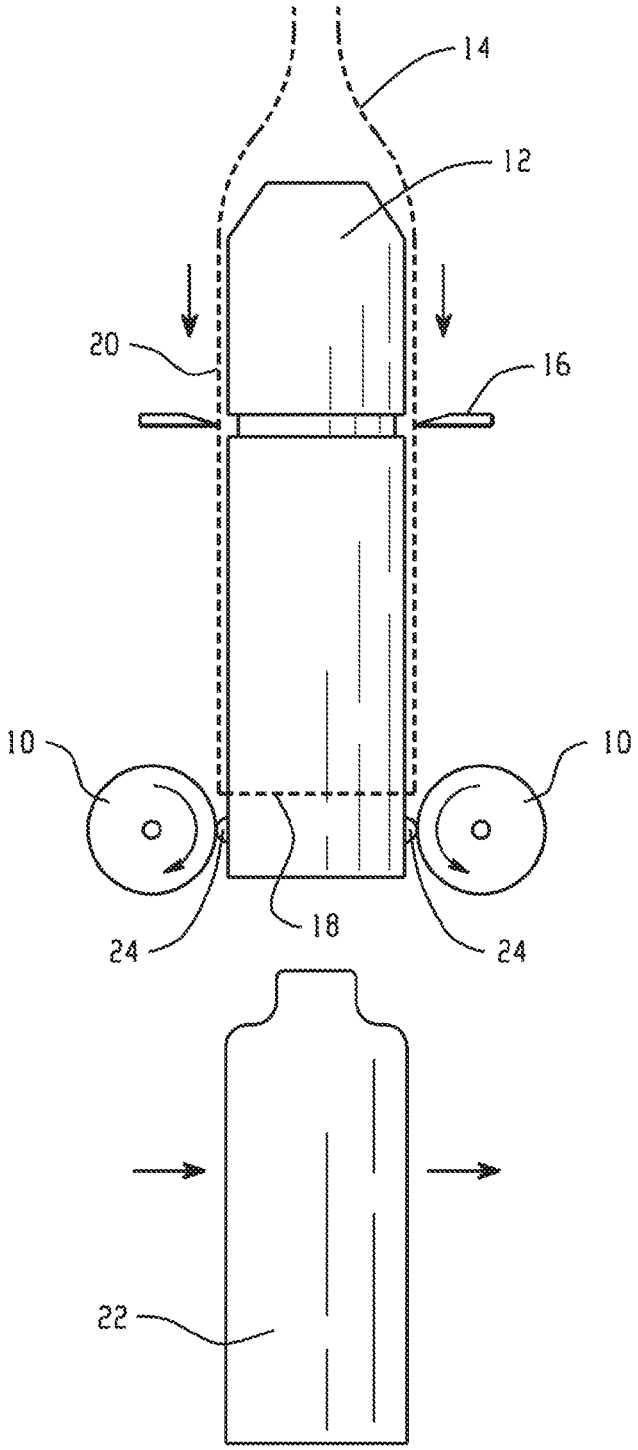
Fig. 1 PRIOR ART
FIG. 1 is a schematic depiction of a prior art shrink sleeve applying apparatus.
Figure 2:
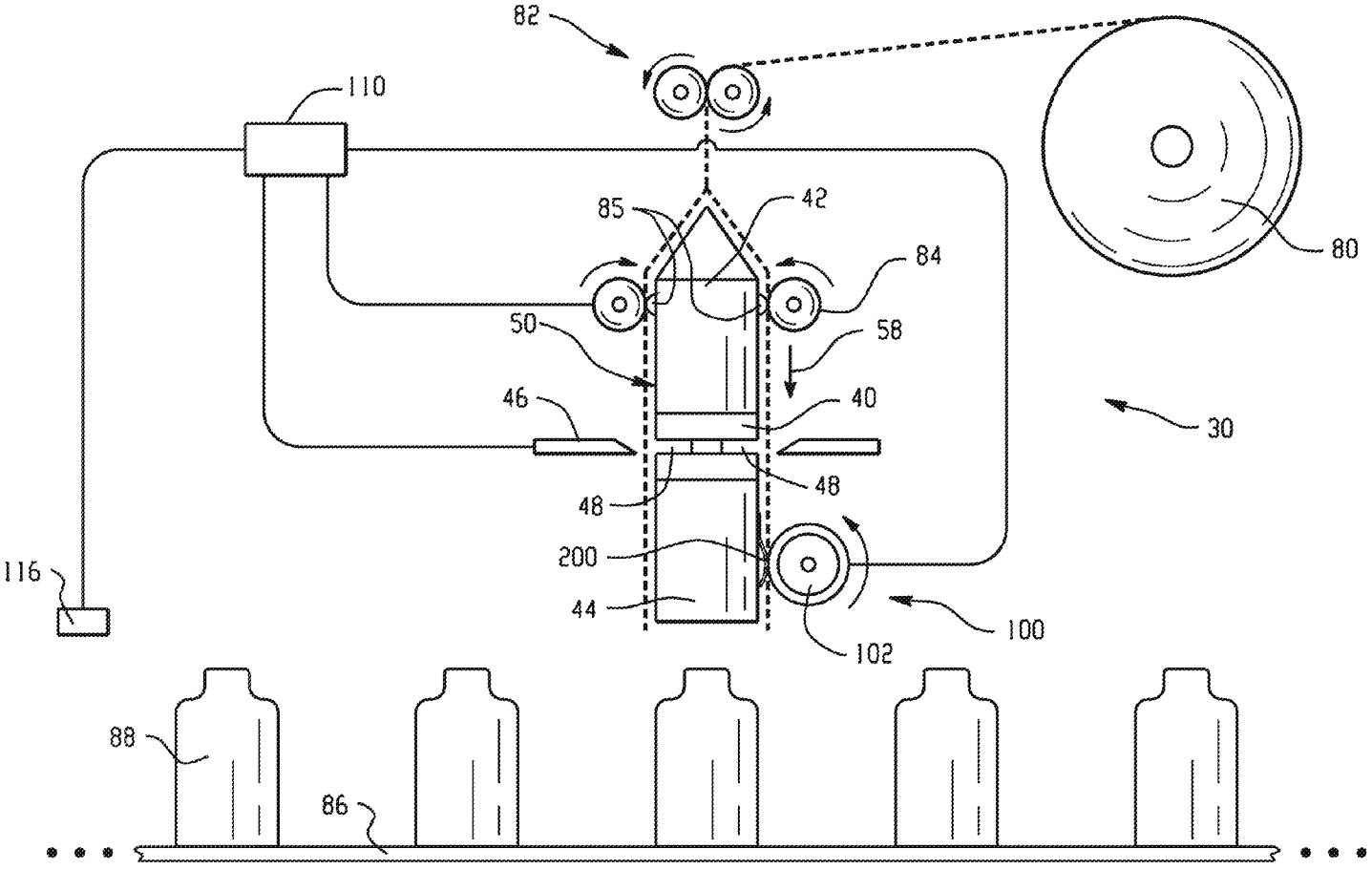
FIG. 2 is a schematic depiction of one embodiment of a shrink sleeve applying apparatus according to the present application.

An exemplary embodiment of a tubular shrink sleeve applying apparatus 30 is shown in schematic form in FIGS. 2 and 3A-3F and includes a roll 80 or other supply of tubular film that delivers the film to a pair of tubular film drivers 82 located above the tooling mandrel 50 for moving the film down toward the mandrel. The top of the tooling mandrel is shaped to cause the tubular film to spread from its flat orientation to an expanded orientation as it moves down around the mandrel 50. A set of film drive rollers 84 controls feeding of the film downward along the mandrel (e.g., per arrow 58) toward a cutting mechanism 46 (e.g., a plurality of circumferentially spaced apart rotating knives or other suitable cutting mechanism) that is aligned with a cutting slot 48 in the external surface of the tooling mandrel. The drive rollers 84 may be positioned to work in cooperation with idler bearings 85 at the external surface of the mandrel assembly. Sleeve drivers 84 operate in coordination with drivers 82 and interact with rollers in the sleeve drive slots to move the tubular film downward along the mandrel assembly. A container conveyance mechanism 86 passes beneath the mandrel and carries containers 88 in a conveyance direction 90 such that cut sleeves are moved off the mandrel assembly and onto the containers passing thereby. A downstream application of heat can then be used to shrink the film. Other variations of the apparatus are possible, including embodiments that do not include the film drivers 82.

In one implementation, the tooling mandrel 50 may be of a multi-component type including an upper part 42, lower part 44 and a cutting insert 40 as described in U.S. Patent Publication No. 2012/0011811, commonly assigned to the assignee of the present application, and which is incorporated herein by reference. However, other tooling mandrel types and configurations are contemplated for use in connection with the innovative cutting arrangement, which is described in detail below.

Ejection of the cut sleeves from the mandrel is a critical feature of any machine of the type described above. In the illustrated embodiment, a sleeve ejection arrangement 100 is provided and includes a sleeve ejector wheel 102 that is positioned at an upward location along the mandrel assembly and is aligned with an outwardly facing contact surface of a spring member 200. This ejector wheel position allows the tubular film to move down between the contact surface of the ejector wheel 102 and the spring surface of the spring member 200 into a position awaiting cut. The spring member may, by way of example, be a leaf spring type spring member formed of a thin, narrow strip of metal or plastic that has its upper end secured to the mandrel assembly. The strip bows outward and downward as shown to a lower end that sits against the mandrel assembly but can move relative to the mandrel assembly to allow for the spring action, thus creating an outward bias of the spring surface into the ejector wheel 102. It is recognized that the spacing of the spring surface radially outward from the generally cylindrical surface of the mandrel may typically be small, and in certain cases (e.g., where the spring member is positioned along a recessed groove of the mandrel) the spring surface may even be generally flush with the overall mandrel outer surface. It is also recognized that other spring member configurations could also be used.

The mandrel assembly includes a sleeve section (e.g., the section located below the film cutter) about which a sleeve length portion of the tubular film extends prior to each cutting operation of the film cutter to produce a cut sleeve. Both the rotatable ejector wheel 102 and the spring member 202 are disposed along the sleeve section of the mandrel assembly. Thus, the tubular film feeds down past the ejector wheel 102 prior to a sleeve being cut. The illustrated embodiment shows a single ejector wheel 102 and spring member 200 set, but it is recognized that more than one pair could be used. For example, two diametrically opposed sets could be used, or three or more sets could be circumferentially spaced about the mandrel assembly.

Figure 3A:
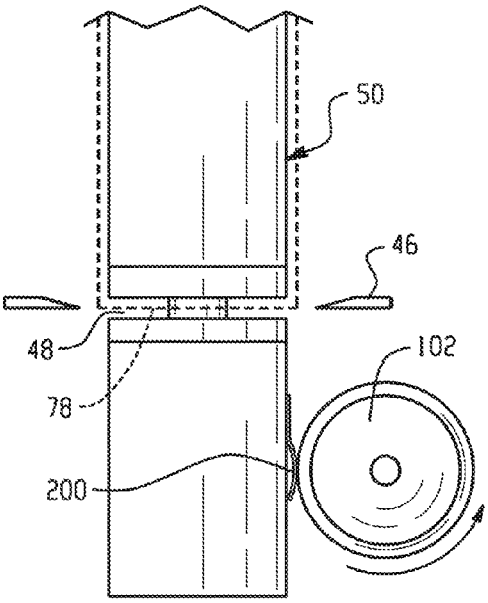
FIGS. 3A-3F are schematic depictions of sleeve cutting and ejection according to the embodiment of FIG. 2.
Figure 3B:
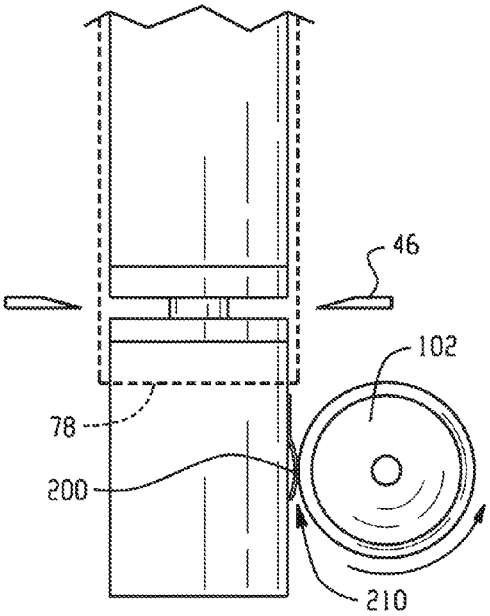
Figure 3C:
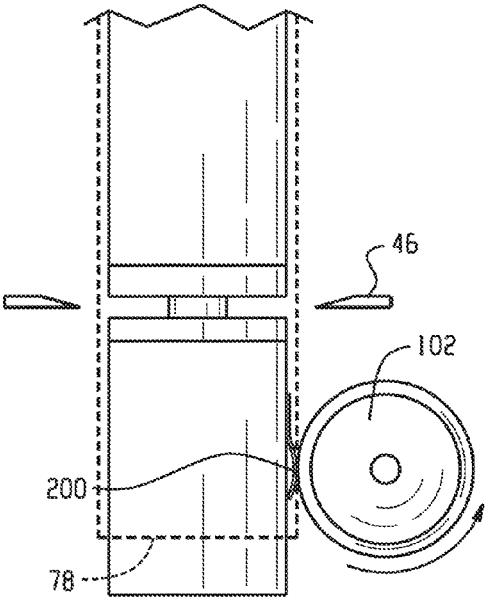
Figure 3D:
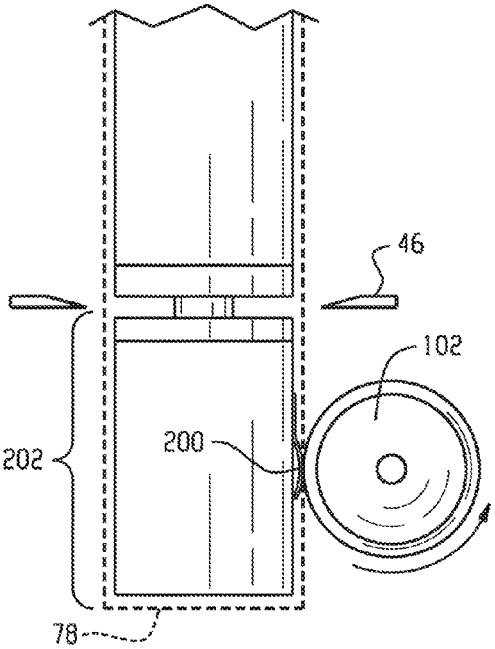
Figure 3E:
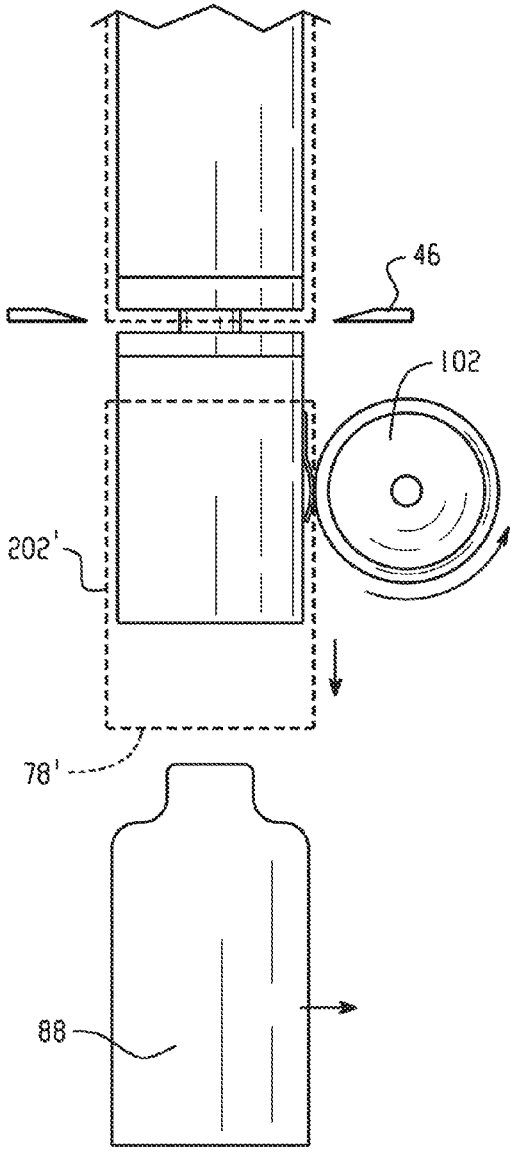
Figure 3F:
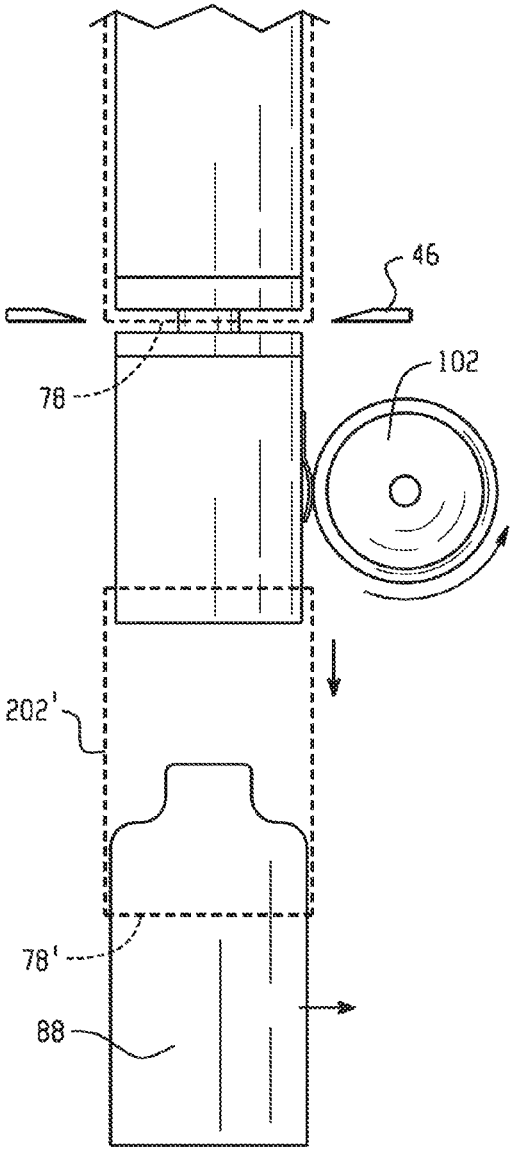
Figure 4:
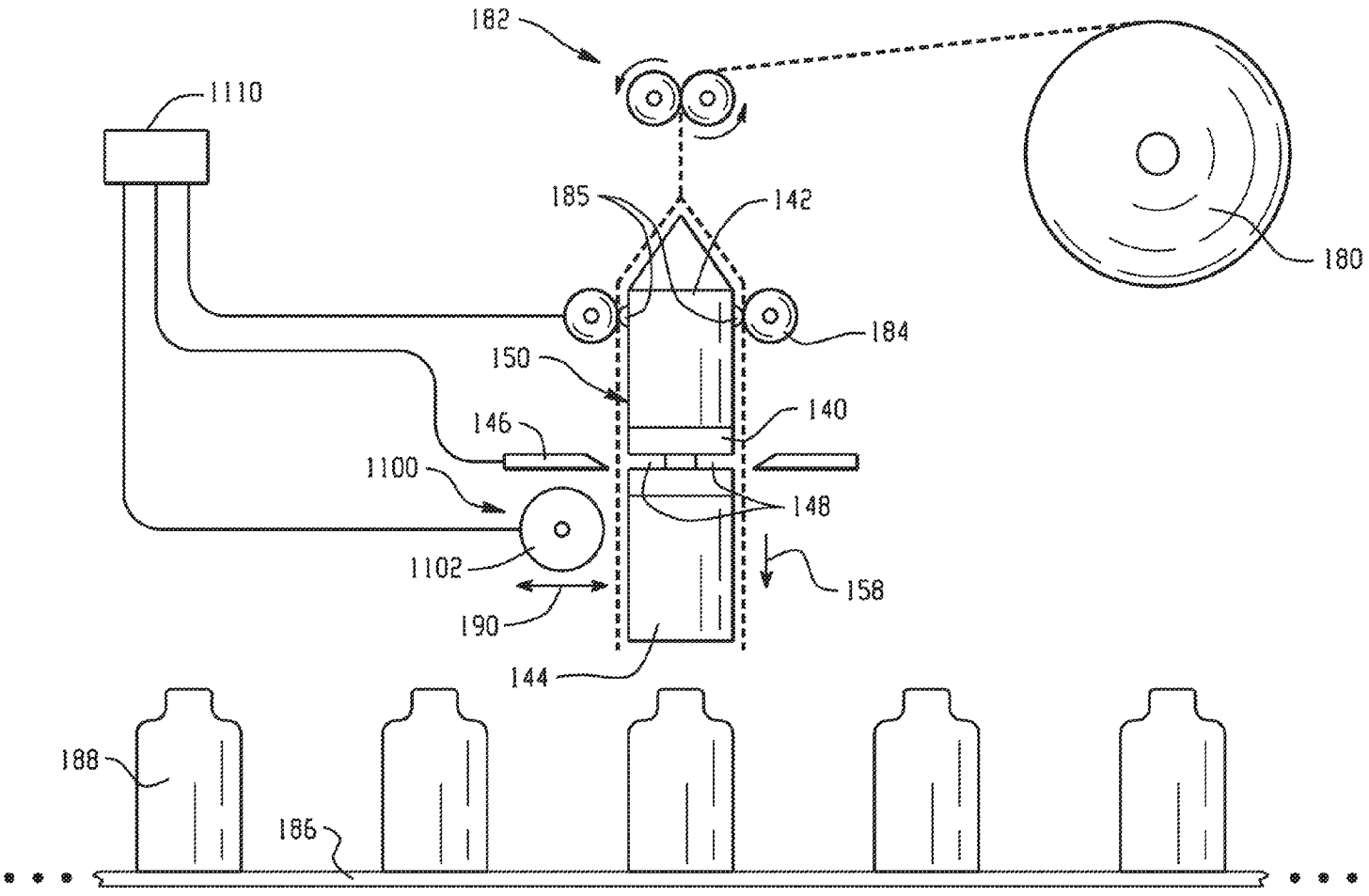
FIG. 4 is a schematic depiction of another embodiment of a shrink sleeve applying apparatus according to the present application.

Referring to FIGS. 3A-3F, a sequence of film feed and cut is shown, where the film is shown in dashed line form. FIG. 3A shows the tubular film with its lower edge 78 in the cutting plane of the film cutter 46 (e.g., as would be the case after a sleeve has been cut and ejected). Per FIG. 3B, the film is fed downward toward the sliding nip 210 formed between the rotating ejector wheel 102 and the spring surface. The term sliding nip is used because the contact surface of the ejector wheel is sliding over the spring surface, which itself does not rotate. Per FIG. 3C the continuing feed of the film moves the film downward so that the lower edge 78 is located below the ejector wheel 102 and an interior surface side of the film is in contact with the spring surface and an exterior surface side of the film is in contact with the rotating ejector wheel. When the film reaches the position shown in FIG. 3D, a sleeve length portion 202 of the tubular film is positioned below the film cutter 46 along the sleeve section of the mandrel assembly, and film feeding is stopped to perform the film cutting operation. When a container 88 is detected below the mandrel (e.g., by breaking a laser beam), the cutter 46 cuts the film to create the sleeve and the rotating ejector wheel 102 causes the cut sleeve to be ejected downward onto the container 88, all of which may be under control of a controller 110.

Notably, the ejector wheel 102 is rotated continuously during the feeding and cutting of the tubular film, so that when the film is stopped for the cut, the contact surface of the rotating ejector wheel 102 slidingly engages the exterior side surface of the sleeve length portion 202 of the film, which pulls the tubular film taught prior to the film cutting operation. The cut sleeve is thereby ejected (per FIGS. 3E and 3F, where the cut sleeve is shown as 202' with lower edge 78') from the mandrel assembly as soon as the film cutting operation is completed.

In order to limit potential damage of the tubular film due to sliding engagement with the contact surface of the ejector wheel 102, the spring member 200 is configured such that an outward bias of the spring surface toward the contact surface of the ejector wheel is small enough to sufficiently limit a sliding frictional force (or coefficient of sliding friction) between the contact surface of the ejector wheel and the exterior surface side of the sleeve length portion. This result may be achieved by suitable sizing and shaping of the spring member, and can be adapted depending upon the particular film being used and/or the size and rotational speed of the ejector wheel and/or the material of the contact surface of the ejector wheel. In this regard, and by way of example only, the contact surface of the ejector wheel may be urethane or silicone, the ejector wheel may be rotated at a speed of between about 50 rpm and about 1750 rpm, and a diameter of the ejector wheel may be between about one inch and about six inches. However, other variations are possible.

In the above described embodiment, the ejector wheel 102 rotates continuously during repeated feed, cut and sleeve eject operations. Accordingly, the ejector wheel 102 can maintain a desired and effective eject rotation speed at all times. Moreover, due the sliding contact with the film prior to ejection, the film is rapidly accelerated off of the mandrel assembly upon completion of the cut.

In the above described embodiment, the ejector wheel 102 is spaced above a bottom of the sleeve section of the mandrel assembly (e.g., by at least about one inch, or at least about two inches) in order to assure that the sliding contact with the sleeve length portion during film cut does not occur right at the bottom edge of the film. This arrangement may, in the case of some films, provide better performance. However, it is recognized that in some embodiments the ejector wheel 102 and spring member 200 set could be located near the bottom edge of the mandrel assembly.

The above described arrangement provides an advantageous method of applying a shrink sleeve label to a container, where the method involves: (a) advancing a leading end of a supply of tubular film over a mandrel assembly, downward past a film cutter and between a sleeve ejector wheel and an outwardly biased spring surface of the mandrel assembly while the sleeve ejector wheel is rotating; and (b) stopping the advance of tubular film when a sleeve length portion of the tubular film is below the film cutter and then cutting the tubular film with the film cutter to produce a separated sleeve, wherein a contact surface of the rotatable ejector wheel slides over an exterior surface side of the sleeve length portion of the tubular film prior to the film cutting operation to pull the tubular film taught prior to the film cutting operation so the separated sleeve is ejected from the mandrel assembly as soon as the film cutting operation is completed. The sleeve ejector wheel causes the separated sleeve to move downward away from the film cutter before uncut tubular film above the film cutter is again advanced. Steps (a) and (b) are performed repeatedly to produce and eject multiple separated sleeves, and the ejector wheel continuously rotates during the repeated performance of steps (a) and (b) without being stopped between each cycle of steps (a) and (b).

In the above described embodiment, a position of a rotation axis of the rotating ejector wheel 102 is fixed relative to the mandrel assembly as each sleeve length portion of the tubular film is fed down between spring surface and the rotatable ejector wheel, then feeding is stopped prior to the film cutting operation. However, other embodiments using a continuously rotating ejector wheel are also contemplated, including embodiments in which the rotation axis of the ejector wheel moves.

By way of example, another exemplary embodiment of a tubular shrink sleeve applying apparatus is shown in schematic form in FIGS. 4 and 5A-5D and includes a roll 180 or other supply of tubular film that delivers the film to a pair of tubular film drivers 182 located above the tooling mandrel 150 for moving the film down toward the mandrel. The top of the tooling mandrel is shaped to cause the tubular film to spread from its flat orientation to an expanded orientation as it moves down around the mandrel 150. A set of film drive rollers 184 controls feeding of the film downward along the mandrel (e.g., per arrow 158) toward a cutting mechanism 146 that is aligned with a cutting slot 148 in the external surface of the tooling mandrel. The drive rollers 184 may be positioned to work in cooperation with idler bearings 185 at the external surface of the mandrel assembly. Sleeve drivers 184 operate in coordination with drivers 182 and interact with rollers in the sleeve drive slots to move the tubular film downward along the mandrel assembly. A container conveyance mechanism 186 passes beneath the mandrel and carries containers 188 in a conveyance direction 190 such that cut sleeves are moved off the mandrel assembly and onto the containers passing thereby. A downstream application of heat can then be used to shrink the film. Other variations of the apparatus are possible, including embodiments that do not include the film drivers 182.

In one embodiment, the tooling mandrel may be of a multi-component type including an upper part 142, lower part 144 and a cutting insert 140 as described in U.S. Patent Publication No. 2012/0011811, commonly assigned to the assignee of the present application, and which is incorporated herein by reference. However, other tooling mandrel types and configurations are contemplated for use in connection with the innovative cutting arrangement of the present application, which is described in detail below.

Ejection of the cut sleeves from the mandrel is a critical feature of any machine of the type described above. In one embodiment, a sleeve ejection arrangement 1100 including a sleeve ejector wheel 1102 that is positioned at an upward location along the mandrel assembly and is spaced away from the external surface of the mandrel. This ejector wheel position allows the tubular film to move down between the ejector wheel 1102 and the external surface of the mandrel into a position awaiting cut. The ejector wheel is movable back and forth toward and away from the mandrel 1142 as suggested by arrow 1198. Although not shown in FIGS. 4 and 5A-5D, the ejector wheel 1102 may be aligned for making contact with a spring member similar to that of the embodiment of FIGS. 2 and 3A-3F.

In one example, when a container 188 is detected below the mandrel (e.g., by breaking a laser beam), the cutter 146 cuts the film to create the sleeve and the ejector wheel 1102 moves toward the mandrel to make contact with the cut sleeve. In another example, the cutter 146 cuts the film to create the sleeve, which remains on the mandrel, and when a container 188 is detected below the mandrel (e.g., by breaking a laser beam), the ejector wheel 1102 moves toward the mandrel to make contact with the cut sleeve. In either example, the rotation of the ejector wheel 1102 causes the cut sleeve to be ejected downward onto the container 188. Once the cut sleeve has been ejected, the wheel 1102 is again retracted and the tubular film is moved downward again toward the position to await the next cut and eject sequence. The sequence is shown in more detail with reference to FIGS. 5A-5D below.

Figure 5A:
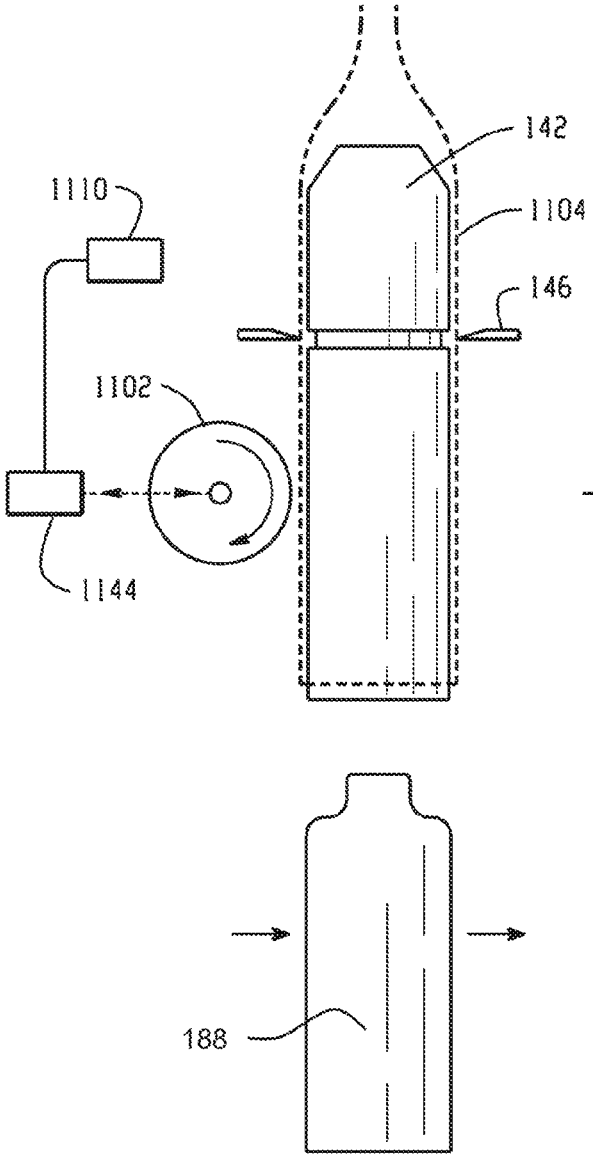
FIGS. 5A-5D are schematic depictions of sleeve cutting and ejection according to the embodiment of FIG. 4.
Figure 5B:
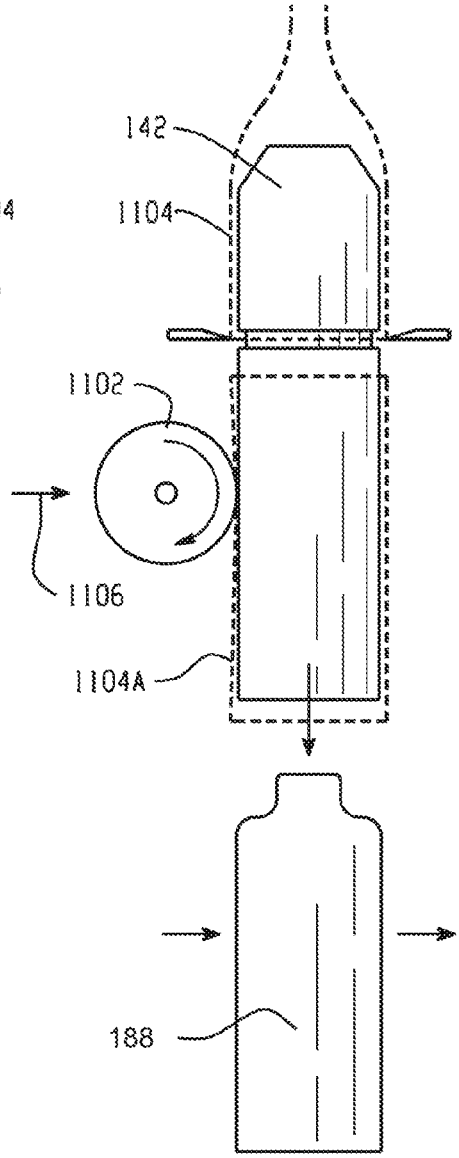
Figure 5C:
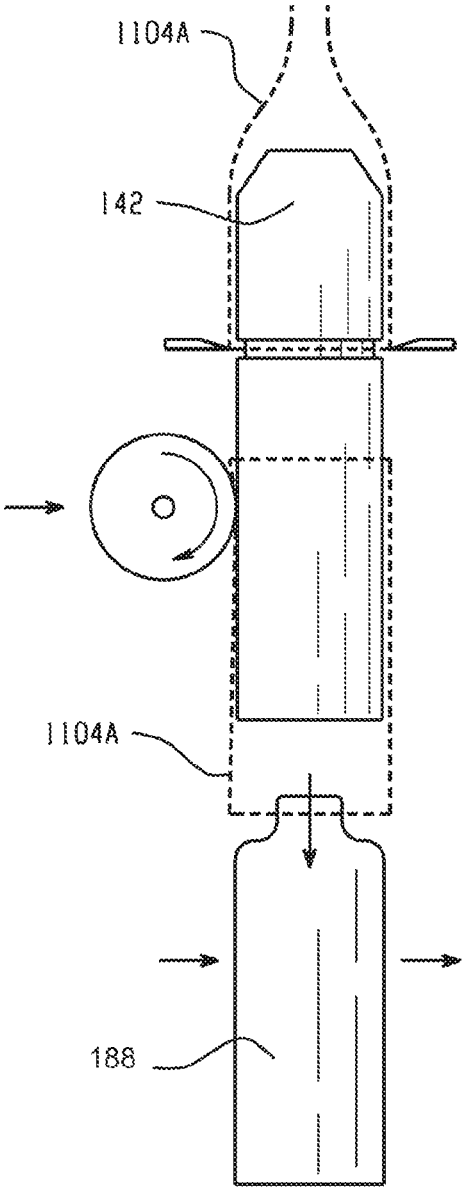
Figure 5D:
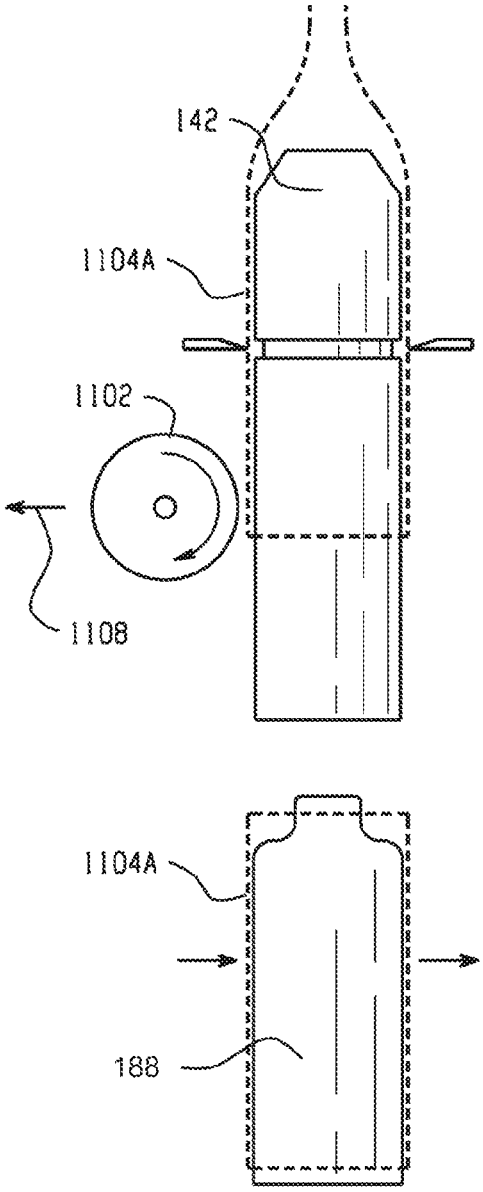

The ejector wheel 1102 is shown in a retracted position in FIG. 5A. Notably, no portion of the ejector wheel 1102 contacts the mandrel assembly when the ejector wheel is in the illustrated retracted position. When the container 188 is detected below the mandrel (e.g., by breaking a laser beam), the cutter 146 cuts the film 1104 to create a sleeve and the ejector wheel 1102 moves (per arrow 1106 in FIG. 5B) toward the mandrel 142 into an eject position so as to make contact with the cut sleeve 1104A. As seen in FIG. 5C, the rotation of the ejector wheel 1102 as it moves into contact with the sleeve 1104A causes the cut sleeve 1104A to be ejected downward onto the container 188. Once the cut sleeve 1104A has been ejected, the wheel 1102 is again retracted (per arrow 133 in FIG. 5D) and the tubular film

1104 is moved downward again toward the position to await the next cut and eject sequence. Notably, in the illustrated sequence the ejector wheel 1102 causes the sleeve 1104A to move downward away from the film cutter 146 before uncut tubular film 1104 above the film cutter is again advanced downward.

In one example, the ejector wheel 1102 has roughly a 1/16 to 3/16" stroke (e.g., about 1/8" stroke) in and out relative to the mandrel 142, but variations are possible. A timer may be used to control the length of time the ejector wheel 1102 spends in the eject position of FIGS. 5B and 5C. For example, when the container 188 is detected, a timed sequence may be initiated for cutting, moving the rotating ejector wheel 1102 into the eject position for a set time period and then moving the rotating ejector wheel back to the retracted position again after the set time period.

In the desirable sleeve ejection arrangement 1100, the rotatable ejector wheel 102 is disposed adjacent the mandrel assembly and movable between the retracted position in which the tubular film can move downward between the ejector wheel and an external surface of the mandrel assembly and the eject position in which the ejector wheel is moved into contact with the tubular film to eject a sleeve of the tubular film from the mandrel assembly.

As shown, the ejector wheel 1102 in the illustrated embodiment is located below the film cutter 146, but is spaced away from a bottom edge of the mandrel assembly. For example, the location at which the ejector wheel perimeter moves into contact with the sleeve material may be at least about one inch above the bottom edge of the mandrel. However, in some implementations better performance may be achieved where the location at which the ejector wheel perimeter moves into contact with the sleeve material is at least about two inches (e.g., three inches or more) above the bottom edge of the mandrel.

In one implementation, the external surface of the mandrel 142 lacks any bearing set below a location of the film cutter. More particularly, in such an example, there is no bearing set on the mandrel that aligns and cooperates with the ejector wheel 1102.

In one implementation, the ejector wheel 1102 rotates continuously as it moves back and forth between the refracted position and the eject position during repeated sleeve cutting and ejection operations. Thus, the ejector wheel can maintain a desired and effective eject rotation speed at all times. In one example, the ejector wheel is rotated at a speed of between about 50 rpm and about 1750 rpm, and a diameter of the ejector wheel is between about one inch and about six inches. However, other variations are possible.

In one implementation, movement of the ejector wheel 1102 is controlled so that the ejector wheel 1102 moves to the eject position and contacts the tubular film only after the film cutter 146 has operated to cut the sleeve. In alternative implementations of this embodiment, (i) the movement of the ejector wheel toward the mandrel assembly may be initiated upon completion of the film cut (e.g., when movement of the cutter is stopped and/or upon detection of a container) or (ii) the movement of the ejector wheel toward the mandrel assembly may be initiated as the cut is taking place (e.g., while the cutter is moving to make the cut). In an alternative embodiment, movement of the ejector wheel 1102 is controlled so that the ejector wheel 1102 moves to the eject position and contacts the tubular film prior to the film cutter operating to complete the cut, such that contact between the ejector wheel and the tubular film pulls the film taught just prior to film cutting, resulting in immediate ejection of the sleeve upon completion of the cut.

In one implementation, a servomotor controlled mechanism 1144 (e.g., under control of a controller 1110 per FIG. 5A) is connected to effect movement of the ejector wheel 1102 back and forth between the retracted position and the eject position. More specifically, such a servomotor controlled mechanism may be configured as a ball screw and associated slide assembly. However, other devices may be used to move the ejector wheel, such as an air cylinder and/or electric linear solenoid and/or linear motor.

The above arrangement achieves a desirable method of sleeve ejection that involves advancing a leading end of a supply of tubular shrink film over a mandrel assembly, downward past a film cutter and beyond a sleeve ejector wheel that is spaced from an outer surface of the mandrel assembly; cutting the tubular shrink film with the film cutter to produce a separated sleeve; moving the sleeve ejector wheel toward the mandrel assembly and into contact with the separated sleeve and rotating the sleeve ejector wheel to eject the separated sleeve downward off of the mandrel assembly; and retracting the sleeve ejector wheel away from the mandrel assembly so as to space the sleeve ejector wheel from the outer surface of the mandrel assembly in order to permit the leading end of the tubular shrink film to again be advanced. In a typical system, the advancing, cutting, moving and retracting steps may be repeatedly performed so to cut and eject multiple separated sleeves onto multiple corresponding containers as those containers pass below the mandrel assembly on a conveyance path or line. Notably, the entire ejection structure (e.g., the rotating ejector wheel) retracts away from the mandrel assembly in the illustrated embodiment, so that no part of the ejection structure is in contact with the mandrel assembly when in the retracted position.

A major difference in the operation of both of the above embodiments as compared to the prior art is that the inventive concepts do not use the film feed to push the cut sleeve. This is advantageous with thin films because the thin films do not push very well do to the thin wall. In the case of both embodiments, the operating method may involve continuously rotating the ejector wheel at a substantially continuous speed so that there is no need to accelerate the ejector wheel each time a sleeve eject is to be performed.

It is to be clearly understood that the above description is intended by way of illustration and example only, is not intended to be taken by way of limitation, and that other changes and modifications are possible. For example, in the embodiment of FIGS. 2 and 3A-3F, the ejector wheel could be movable solely for the purpose of down or wait times. In particular, a sensor arrangement 116 at the front of the machine may be used to detect whether any container are incoming. If there are no incoming containers, the ejector wheel 102 may be moved out of contact with the spring surface so that when the machine is not actively being used to apply labels the wheel is not unnecessarily rubbing against the spring surface. In the embodiment of FIGS. 4 and 5A-5D a similar retract operation could be implemented. Moreover, in embodiments in which the ejector wheel is movable inward and outward relative to the mandrel assembly, the machine controller could include different programmed operating modes that could be selected based upon (i) tubular film type and/or (ii) container type and/or (iii) one or more other factors. Thus, such a machine could include one sleeving mode in which the ejector wheel is repeatedly moved inward and outward during sleeving operations, and another sleeving mode in which the ejector wheel is maintained in the same position relative to the mandrel assembly during sleeving operations. Likewise, different modes could include different defined ejector wheel rotation speeds. Other variations are also possible.

What is claimed is:

1. A machine for applying tubular film to products, the machine including:

a mandrel assembly about which tubular film is passed as the tubular film is fed downward over the mandrel assembly;

a film cutter positioned along the mandrel assembly for cutting the tubular film into sleeves sized for application to containers passing below the mandrel assembly, the mandrel assembly including a sleeve section located below the film cutter and about which a sleeve length portion of the tubular film extends prior to each cutting operation of the film cutter to produce a cut sleeve;

a sleeve ejection arrangement including a rotatable ejector wheel disposed along the sleeve section of the mandrel assembly so as to be positioned along each sleeve length portion of the tubular film prior to each film cutting operation, wherein the rotatable ejector wheel is rotated continuously during repeated feeding and cutting of the tubular film to produce multiple cut sleeves that are sequentially ejected from the mandrel assembly;

wherein the rotatable ejector wheel is engaged with each sleeve length portion of the tubular film prior to the film cutting operation, wherein the engagement between the ejector wheel and the sleeve length portion pulls the tubular film taught prior to the film cutting operation so each cut sleeve is ejected from the mandrel assembly as soon as the film cutting operation is completed;

wherein the sleeve section of the mandrel assembly includes a outwardly biased but movable spring surface aligned with and contacting the rotatable ejector wheel, and each sleeve length portion of the tubular film is engaged on an interior surface side by the spring surface and on an exterior surface side by the rotatable ejector wheel.

2. The machine of claim 1 wherein a contact surface of the rotatable ejector wheel slides over the exterior surface side of each sleeve length portion of the tubular film prior to the film cutting operation, wherein an outward bias of the spring surface is small enough to limit a sliding friction force between the contact surface of the ejector wheel and the exterior surface side of the sleeve length portion so as to limit film damage as a result of the sliding contact.

3. The machine of claim 1 wherein the rotatable ejector wheel remains in contact with the spring surface or tubular film alongside the spring surface at all times.

4. The machine of claim 1 wherein the ejector wheel is spaced above a bottom of the sleeve section of the mandrel assembly by at least one inch.

5. The machine of claim 1 wherein the ejector wheel causes each cut sleeve to move downward away from the film cutter before uncut tubular film above the film cutter is advanced downward.

6. The machine of claim 1 wherein the ejector wheel is movable between a retracted position in which the tubular film can move downward between the ejector wheel and an external surface of the mandrel assembly and an eject position in which the ejector wheel is moved into contact with the tubular film to eject a cut sleeve of the tubular film from the mandrel assembly.

7. A machine for applying tubular film to products, the machine including:

a mandrel assembly about which tubular film is passed as the tubular film is fed downward over the mandrel assembly;

a film cutter positioned along the mandrel assembly for cutting the tubular film into sleeves sized for application to containers passing below the mandrel assembly, the mandrel assembly including a sleeve section located below the film cutter and about which a sleeve length portion of the tubular film extends prior to each cutting operation of the film cutter to produce a cut sleeve;

a sleeve ejection arrangement including a rotatable ejector wheel disposed along the sleeve section of the mandrel assembly so as to be positioned along each sleeve length portion of the tubular film prior to each film cutting operation, wherein the rotatable ejector wheel is rotated continuously during repeated feeding and cutting of the tubular film to produce multiple cut sleeves that are sequentially ejected from the mandrel assembly, wherein the ejector wheel is movable between a retracted position in which the tubular film can move downward between the ejector wheel and an external surface of the mandrel assembly without the ejector wheel contacting the tubular film, and an eject position in which the ejector wheel is moved into contact with the tubular film to eject a cut sleeve of the tubular film from the mandrel assembly, wherein the ejector wheel rotates continuously as it moves back and forth between the retracted position and the eject position during repeated sleeve cutting and ejection operations.

8. The machine of claim 7 wherein movement of the ejector wheel is controlled so that the ejector wheel moves to the eject position and either (i) contacts the sleeve length portion of the tubular film prior to the film cutting operation such that contact between the ejector wheel and the sleeve length portion pulls the film taught prior to film cutting or (ii) contacts the cut sleeve only after the film cutting operation so that the cut sleeve sits on the sleeve section and awaits contact by the ejector wheel.

9. A machine for applying tubular film to products, the machine including:

a mandrel assembly about which tubular film is passed;

a film cutter positioned along the mandrel assembly for cutting the tubular film into sleeves sized for application to containers passing below the mandrel assembly, the mandrel assembly including a sleeve section located below the film cutter and about which a sleeve length portion of the tubular film extends prior to each film cutting operation of the film cutter to produce a cut sleeve;

a sleeve ejection arrangement including a rotatable ejector wheel disposed along the sleeve section of the mandrel assembly such that the rotatable ejector wheel is positioned along each sleeve length portion of the tubular film prior to the film cutting operation, wherein the sleeve section of the mandrel assembly includes spring surface aligned with and outwardly biased toward the rotatable ejector wheel.

10. The machine of claim 9 wherein each sleeve length portion of the tubular film is fed between the spring surface and the ejector wheel, and each cut sleeve is engaged on an interior surface side by the spring surface and on exterior surface side by the rotatable ejector wheel during ejection.

11. The machine of claim 10 wherein a contact surface of the rotatable ejector wheel slides over the exterior surface side of each sleeve length portion of the tubular film prior to the film cutting operation.

12. The machine of claim 9 wherein the rotatable ejector wheel is rotated continuously during repeated feeding and cutting of the tubular film to produce multiple cut sleeves that are sequentially ejected from the mandrel assembly.

13. The machine of claim 9 wherein the ejector wheel engages each sleeve length portion of the tubular film to pull the tubular film taught prior to the film cutting operation so each cut sleeve is ejected from the mandrel assembly as soon as the film cutting operation is completed.

14. The machine of claim 9 wherein the ejector wheel is movable between an eject position adjacent the spring surface and a retracted position spaced from the spring surface.

15. The machine of claim 14 wherein the ejector wheel is controlled so that the ejector wheel moves to the eject position and either (i) contacts the sleeve length portion of the tubular film prior to the film cutting operation such that contact between the ejector wheel and the sleeve length portion pulls the film taught prior to film cutting or (ii) contacts the cut sleeve only after the film cutting operation so that the cut sleeve sits on the sleeve section and awaits contact by the ejector wheel.

16. A machine for applying tubular film to products, the machine including:

a mandrel assembly about which tubular film is passed;

a film cutter positioned along the mandrel assembly for cutting the tubular film into sleeves sized for application to containers passing below the mandrel assembly, the mandrel assembly including a sleeve section located below the film cutter and about which a sleeve length portion of the tubular film extends prior to each film cutting operation of the film cutter to produce a cut sleeve;

a sleeve ejection arrangement associated with the mandrel assembly, the sleeve ejection arrangement including a rotatable ejector wheel disposed along the sleeve section of the mandrel assembly such that the rotatable ejector wheel is positioned above a bottom edge of the tubular film prior to film cutting, wherein the sleeve section of the mandrel assembly includes an outwardly biased but movable spring surface aligned with the rotatable ejector wheel, and each cut sleeve is engaged on an interior surface side by the spring surface and on an exterior surface side by the rotatable ejector wheel during ejection.

17. The machine of claim 16 where the ejector wheel is both rotating and engaged with each sleeve length portion of the tubular film prior to each film cutting operation so that each cut sleeve is ejected from the mandrel assembly as soon as the film cutting operation is completed.

18. The machine of claim 16 wherein the ejector wheel is movable between an eject position toward the mandrel assembly and a retracted position further from the mandrel assembly.

19. The machine of claim 18 wherein a sensor arrangement is positioned for detecting a condition when containers are not being delivered into the machine, and the ejector wheel is moved to the retracted position upon detection of the condition.

20. A machine for applying tubular film to products, the machine including:

a mandrel assembly about which tubular film is passed as the tubular film is fed downward over the mandrel assembly;

a film cutter positioned along the mandrel assembly for cutting the tubular film into sleeves sized for application to containers passing below the mandrel assembly, the mandrel assembly including a sleeve section located below the film cutter and about which a sleeve length portion of the tubular film extends prior to each cutting operation of the film cutter to produce a cut sleeve;

a sleeve ejection arrangement including a rotatable ejector wheel disposed below the film cutter and along the sleeve section of the mandrel assembly so as to be positioned along each sleeve length portion of the tubular film prior to each film cutting operation, wherein the rotatable ejector wheel is rotated continuously during repeated feeding and cutting of the tubular film to produce multiple cut sleeves that are sequentially ejected from the mandrel assembly, wherein a contact surface of the rotatable ejector wheel slides over an exterior surface side of each sleeve length portion of the tubular film prior to the film cutting operation so that sliding contact between the ejector wheel and the sleeve length portion pulls the film taught prior to film cutting and each cut sleeve is ejected immediately upon completion of film cutting, wherein the sleeve section of the mandrel assembly includes a outwardly biased spring surface aligned with the rotatable ejector wheel, and each sleeve length portion of the tubular film is engaged on an interior surface side by the spring surface and the exterior surface side by the rotatable ejector wheel prior to film cutting.

* * * * *